United States Patent [19]

Nissen

[11] Patent Number: 4,759,698

[45] Date of Patent: Jul. 26, 1988

[54] ROTARY COMPRESSOR WITH OIL CONVEYING MEANS TO SHAFT BEARINGS

[75] Inventor: Harry S. Nissen, Sonderborg, Denmark

[73] Assignee: Danfoss A/S, Nordborg, Denmark

[21] Appl. No.: 33,867

[22] Filed: Apr. 6, 1987

Related U.S. Application Data

[63] Continuation of Ser. No. 854,070, Apr. 17, 1986, abandoned, which is a continuation of Ser. No. 717,902, Mar. 29, 1985, abandoned.

[30] Foreign Application Priority Data

Apr. 11, 1984 [DE] Fed. Rep. of Germany ..... 3413536

[51] Int. Cl.[4] ..... F04C 18/356; F04C 29/02

[52] U.S. Cl. ..... 418/63; 418/88; 418/94; 418/98

[58] Field of Search ..... 418/63, 76, 88, 94, 418/98, 99; 417/902; 184/6.16

[56] References Cited

U.S. PATENT DOCUMENTS

| | | | |
|---|---|---|---|
| 2,306,608 | 12/1942 | Hubacker | 418/76 |
| 2,669,384 | 2/1954 | Dills | 418/63 |
| 3,385,513 | 5/1968 | Kilgore | 418/98 |
| 4,144,002 | 3/1979 | Shibuya et al. | 418/94 |
| 4,456,437 | 6/1984 | Kurahayashi et al. | 418/88 |

FOREIGN PATENT DOCUMENTS

| | | | |
|---|---|---|---|
| 57-8391 | 1/1982 | Japan | 418/94 |
| 58-158393 | 9/1983 | Japan | 418/76 |

*Primary Examiner*—John J. Vrablik

*Attorney, Agent, or Firm*—Wayne B. Easton

[57] ABSTRACT

The invention relates to a rotary compressor assembly of the type in which an electric motor and a rotary compressor are mounted in a seal capsule and share a common drive shaft. An intermediate pressure chamber is formed in the housing adjacent the outboard bearing of the compressor and a nonmechanical pressure difference principle is utilized to convey lubricating oil from the pump to the intermediate pressure chamber. A groove and paddle construction associated with the shaft conveys oil from the intermediate pressure chamber against the capsule pressure back into the capsule through the shaft bearings.

8 Claims, 2 Drawing Sheets

Figure 1:
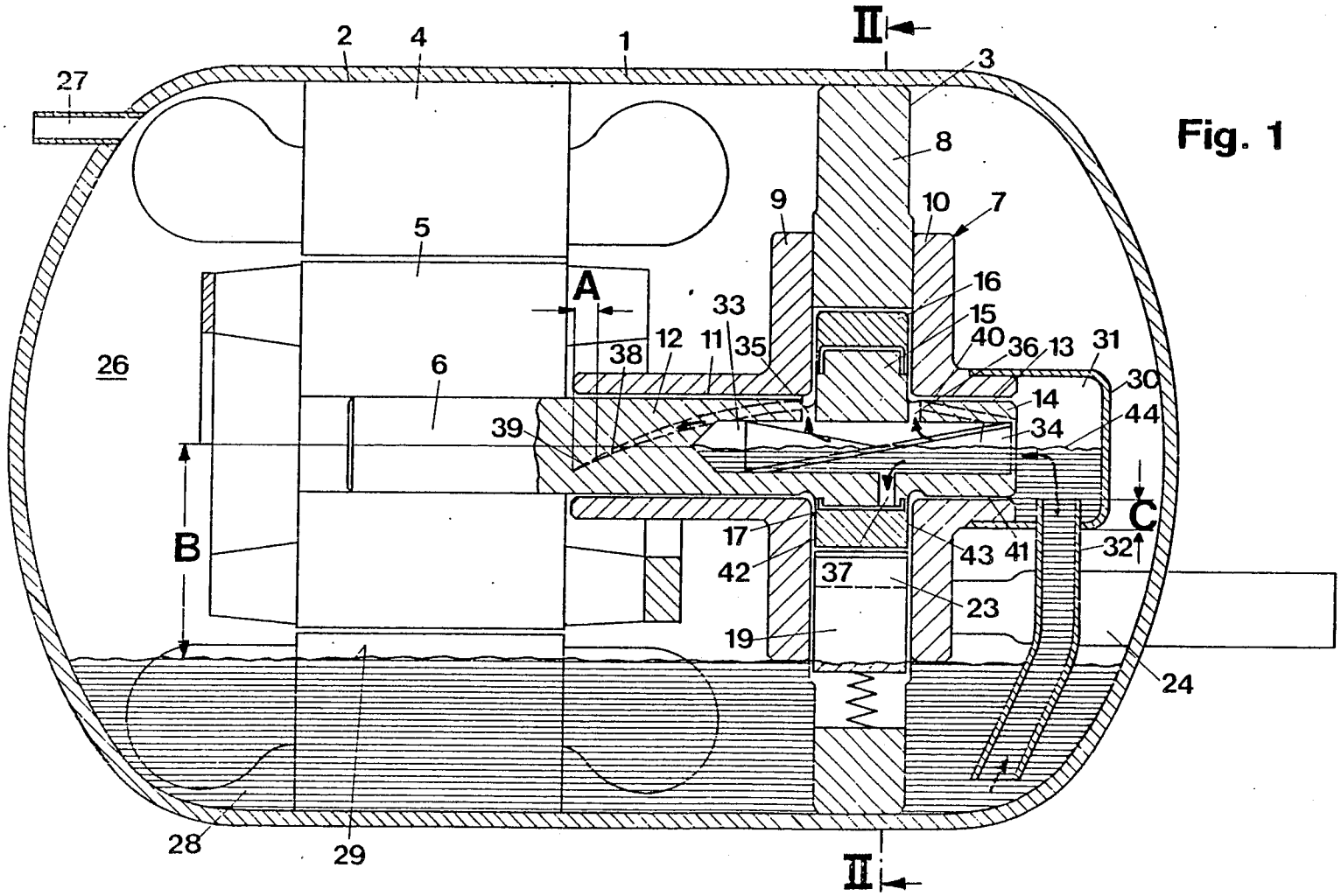

II
II
A
B
C
1
2
3
4
5
6
7
8
9
10
11
12
13
14
15
16
17
19
23
24
26
27
28
29
30
31
32
33
34
35
36
37
38
39
40
41
42
43
44

ROTARY COMPRESSOR WITH OIL CONVEYING MEANS TO SHAFT BEARINGS

This is a continuation of prior application Ser. No. 854,070, filed Apr. 17, 1986 which was a continuation of prior original application Ser. No. 717,902, filed Mar. 29, 1985, both of said prior applications now having the status of abandonment.

The invention relates to a rotary compressor of which the substantially horizontally extending shaft is driven by an electric motor and which is disposed in a capsule having an oil sump and under compressor pressure, comprising a shaft bearing lubricator in which oil is driven by the pressure difference between capsule pressure and suction pressure through a path leading from the oil sump through a supply connector to an intermediate pressure chamber near the shaft and then to the suction side. The last flow to the suction side is nonliquid flow.

A known rotary compressor of this kind (U.S. Pat. No. 19 28 300) serving as a refrigerant compressor is accommodated in a capsule under compressor pressure whereas its driving motor is in a separate chamber connected to the suction line. The rotary compressor comprises a rotor with four radially adjustable vanes which are guided at an eccentric running face of the stator and move past grooves on the pressure and suction sides. The level of the oil sump is above the two-part shaft. A path extends from the oil sump through a supply connector and a valve arrangement to intermediate pressure chambers which are momentarily formed by pressure chambers at the inner side of the vanes. The path continues through a lubricating point between the shaft bearing of the compressor on the motor side, then through a central bore of the motor shaft and finally through the shaft bearing of the motor shaft remote from the compressor to the interior of the motor housing that is under suction pressure. Further, oil can flow out of the pressure chamber behind the vanes along the vanes to the suction side of the compressor.

However, it is a disadvantage that the motor is separated from the compressor and two chambers at different pressures have to be provided. In most refrigerant compressors produced to-day, the compressor and motor are combined as a unit in a capsule, which permits smaller constructions as well as simplifications, for example the use of a common and shorter shaft.

The invention is based on the problem of providing a rotary compressor of the aforementioned kind that can form a unit with its motor and nevertheless utilise the advantages of pressure difference lubrication.

This problem is solved according to the invention in that the motor is also disposed in the capsule and that the shaft is provided with conveyor means conveying the oil from the intermediate pressure chamber through the at least one shaft bearing on the motor side back into the capsule.

In this construction, the compressor and motor are disposed in a common capsule. The pressure difference principle is utilised for the first part of the oil flow, namely up to the intermediate pressure chamber. The oil is therefore lifted to the level of the shaft without mechanically moved parts. For the second part of flow, on the other hand, provision is made for conveyor means which are easily formed near the shaft and capable of conveying oil against the pressure difference between the capsule pressure and intermediate pressure through the shaft bearing on the motor side back into the capsule. This takes account of the fact that, in the absence of a motor housing under vacuum, no pressure difference is available to drive the oil out of the intermediate pressure chamber through the shaft bearing on the motor side. However, on the other hand the suction pressure in the region of the compressor is available, so that the pressure difference can still be utilised to bring about the first part of the flow. Since a large part of the pressure drop between the capsule pressure and suction pressure can be utilised because of the additional conveyor means, whereby to lift the oil to the level of the shaft, the level of the oil sump may also be below the shaft and preferably below the rotor of the motor.

In a particularly simple embodiment, the conveyor means comprise a spiral groove between the shaft and the shaft bearing on the motor side. Such a spiral groove ensures forced flow and is capable of overcoming considerable pressure differences.

With particular advantages, the outlet of the oil leaving the shaft bearing on the motor side is provided with a throttle. This throttle ensures that, during standstill periods, the capsule pressure does not, or not so rapidly, advance into the intermediate pressure chamber so that there is still oil there during the next start.

In particular, the throttle may be formed by a groove end section which adjoins the spiral groove and has a smaller cross-section than same.

It is particularly favourable for the level of the oil sump to be under the rotor of the motor so that a conveying height results in the intermediate pressure chamber up to the working level, and for the throttle to be so dimensioned in relation to the viscosity of the oil that it acts as a stop at an intermediate pressure corresponding to the conveying height. In this way, one ensures that the oil level during standstill of the compressor will now drop out of the intermediate pressure chamber even though the oil sump is comparatively low.

It is also advantageous for the rotary compressor to comprise an eccentric connected to the shaft, a rolling piston mounted thereon, and a sealing fin which is mounted in the housing and pressed against the rolling piston to separate the pressure and suction chambers, and for the end section of the path leading to the suction side to be formed by the play between the ends of the rolling piston and the adjacent housing parts. If one chooses a rotary compressor of this construction, at least the last portion of the path leading to the suction side is obtained without taking constructional measures. The pressure drop along this last section is large because there is little play to avoid oil leakage into the suction chamber. The pressure difference between capsule pressure and intermediate pressure is, however, still high enough to lift the oil without problems up to the level of the shaft.

It is also favourable for a blind hole running axially in the shaft to extend from the intermediate pressure chamber at the free shaft end and be connected to the lubricating point at the shaft bearing on the motor side by way of a distributing hole leading to the periphery. In this way, the oil flows from the freely accessible end to the shaft bearing on the motor side offset axially therefrom.

Another distributing hole extending from the blind hole can lead to the shaft bearing surrounding the free shaft end. In this case it is desirable for a spiral groove conveyor also to be provided between the free shaft end and the associated shaft bearing.

A still further distributing hole extending from the blind hole can lead to the bearing surface between the eccentric and rolling piston.

These distributing holes also form paths parallel to the rotary play between the free shaft end and the associated shaft bearing and therefore belong to the path section between the intermediate pressure chamber and the suction side.

The conveying action is enhanced if the paddles of a paddle pump are disposed in the blind hole.

The supply connector should project into the intermediate pressure chamber at least up to a little above the underside of the shaft. This ensures that, on standstill, an oil reserve remains in the intermediate pressure chamber to be available for the next start.

A particularly simple solution of forming the intermediate pressure chamber is to place a pot on the housing surrounding the free shaft end.

Figure 2:
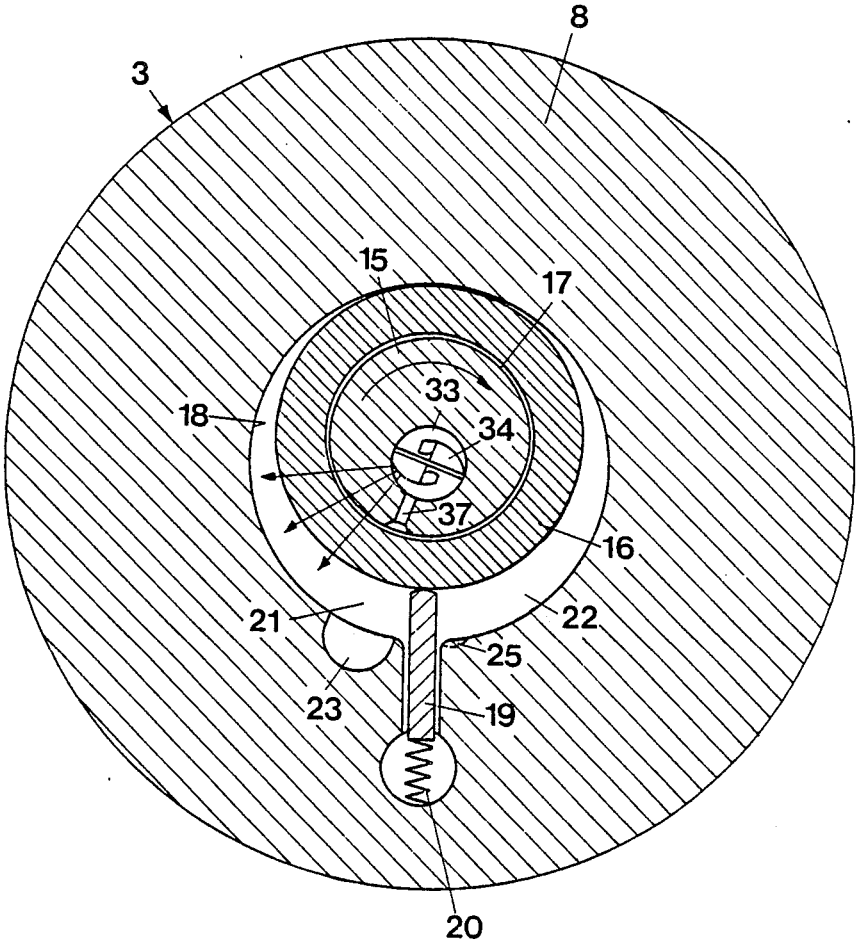

A preferred example of the invention will now be described in more detail with reference to the drawings, in which:

FIG. 1 is a longitudinal section through a rotary compressor according to the invention in its capsule, and FIG. 2 is a section on line II—II in FIG. 1.

An electric motor 2 and a rotary compressor 3 driven thereby are disposed in a capsule 1. The electric motor comprises a stator 4 and a rotor 5 provided with a shaft 6.

The rotary compressor 3 has a housing 7 consisting of a stator 8 held in the capsule, an end portion 9 on the motor side and an end portion 10. The end portion 9 on the motor side forms a shaft bearing 11 on the motor side for a shaft section 12 on the motor side. The other end portion 10 forms a terminal shaft bearing 13 for the free shaft end 14. The shaft 6 is provided with an eccentric 15 surrounded by a rolling piston 16 to form an eccentric bearing 17. The rolling piston runs along an inner circumferential surface 18 of the stator 8 that is concentric with the shaft axis. A sealing fin 19 is pressed radially inwardly against the rolling piston 16 by the force of a spring 20 during starting and in operation also by the pressure in capsule 1, so that a suction chamber 21 and pressure chamber 22 are formed. The suction chamber communicates with a suction groove 23 which, in turn, is connected to the suction connector 24. The flow of oil in the last section is a nonliquid flow. The pressure chamber communicates with a pressure orifice 25 which leads to the interior 26 of the capsule from which a pressure connector 27 extends.

In the lower part of the capsule there is an oil sump 28 of which the level 29 still lies below the rotor 5 of electric motor 2. A pot 30 is sealingly placed on the end portion 10 with a force fit; its interior forms an intermediate pressure chamber 31 and communicates with the oil sump 28 through a supply connector 32. The shaft 6 has a blind hole 33 which extends from the free end and in which there is inserted a paddle pump 34 formed by spirally wound sheet metal. Three radial holes extend from this axial bore 33, namely a radial hole 35 leading to the shaft bearing 11 on the motor side, a radial hole 36 leading to the end shaft bearing 13, and a third radial hole 37 leading to eccentric bearing 17. On the outside of the shaft section 12 on the motor side conveyor means are provided in the form of a spiral groove 38 terminating at a spacing A from the end of the shaft bearing 11 on the motor side. It continues in the form of a groove of smaller cross-section than the spiral groove 38 up to the end or a little beyond to act as a throttle 39. A further spiral groove 40 on the outside of shaft section 12 is on the free shaft end 14.

When the rotary compressor is in operation, the compressor or working pressure obtains in the capsule interior 26 and a considerably lower pressure, namely the suction pressure, in the suction groove 23. The pressure difference is usually between about 5 and 15 bar. Between the chambers at working and suction pressure there is a path comprising the supply connector 32, the intermediate pressure chamber 31, a shunt circuit comprising the bearing play 41 between the shaft end 14 and the associated shaft bearing 13 and the three radial holes 35, 36 and 37 in conjunction with the play of the eccentric bearing 17, and in the last section the play 42 and 43 between the rolling piston 16 and the adjacent end portions 9 and 10. The pressure drop created along this path leads to an intermediate pressure in the intermediate pressure chamber 31 that lies below the capsule pressure. Consequently, oil is lifted from the oil sump 28 up to the level of shaft 6 so that the oil level 44 is obtained, i.e. the conveying height B of for example 30 to 50 mm. From here on, conveying is by means of the paddle pump 34. The spiral groove conveying means 38 ensure that the shaft bearing 11 on the motor side will be lubricated even though the oil has to be conveyed against the pressure in the capsule interior 26. One therefore obtains lubrication as depicted by the arrows in FIG. 1.

When switching the rotary compressor off, the throttle 39 has the effect that, by reason of the viscosity of the oil, the capsule pressure is insufficient for pressing the oil in the spiral groove back into the intermediate pressure chamber. Since the suction pressure in the system is in any event maintained for prolonged periods, practically the same as the original operating conditions are available for the next start.

If the oil level 44 should nevertheless drop on account of unfavourable conditions, the supply connector 32 is so inserted in the pot 30 that it projects upwardly by the distance C. The top therefore rises to a little above the underside of shaft 6. This ensures that a residue of oil will remain in pot 30 even if the oil has otherwise dropped out of the intermediate pressure chamber 31 and the supply connector 32. This oil residue is sufficient for lubrication during the next start. Full lubrication is, however, available again immediately thereafter.

I claim:

1. A rotary compressor assembly, comprising, a capsule forming an oil sump in the lower part thereof, an electric motor and a rotary compressor mounted in said capsule, said compressor having a suction inlet and a pressure outlet, said compressor pressure outlet being in fluid communication with the interior of said capsule to provide a capsule pressure to which oil in said oil sump is subjected, a suction inlet connector extending from outside said capsule to said suction inlet of said compressor, shaft means for said motor and said compressor, said shaft means including inboard and outboard shaft portions on opposite sides of said compressor, housing means for said compressor internally of said capsule forming inboard and outboard bearings for said shaft portions and parallel mutually facing interior wall means between said bearings extending normal to said shaft, said compressor having rotor means in sliding and sealing contact with said wall means operably connected to and driven by said shaft means, means cooperating with said rotor means to form suction and pressure chambers interiorly of said housing means on opposite sides of said contact, said housing means forming an outboard chamber in juxtaposition to and extending horizontally outwardly from said outboard bearing, a supply pipe between said oil sump and said outboard chamber having an inlet below the intended oil level of said sump, said sealing contact forming a section flow path section between said suction chamber and said outboard chamber for maintaining a chamber pressure in said outboard chamber intermediate said capsule and suction pressures, said sealing contact presenting a sufficient resistance to fluid flow therethrough to allow only a liquid flow of oil from said oil sump to said outboard chamber to establish and maintain a defined liquid level in said outboard chamber and to allow only a nonliquid flow of oil through said sealing contact from said outboard chamber to said suction chamber, and mechanical means associated with said shaft means for conveying lubricating oil from said outboard chamber along a path which leads from said outboard chamber to said sump via at least one of said bearings.

2. A rotary compressor assembly according to claim 1 characterized in that said mechanical means includes spiral groove means in the surface of said shaft means and at least one of said bearing.

3. A rotary compressor assembly according to claim 2 characterized in that said mechanical means includes throttle means terminating said groove means to deter the leakage of oil from said outboard chamber to said sump during shut-off periods of said motor.

4. A rotary compressor assembly according to claim 3 characterized in that said throttle means is formed by a groove section which adjoins said spiral groove means and has a smaller cross-section that said spiral groove means.

5. A rotary compressor assembly according to claim 3 characterized in that the level of said sump is lower than said outboard chamber, said throttle means being dimensioned with respect to the viscosity of said oil so that an intermediate pressure and an oil level is established in said outboard chamber.

6. A rotarcy compressor assembly according to claim 1 characterized in that said rotor means includes an eccentric for said shaft and a rolling piston mounted thereon, a sealing fin and pressure chambers, and said sealing contact being formed by play between the ends of said rolling piston and said housing interior wall means.

7. A rotary compressor assembly according to claim 1 characterized in that said mechanical means includes a blind hole running axially in said shaft from said outboard chamber, and radially extending hole means extending from said blind hole to the periphery of said shaft for lubricating said bearings.

8. A rotary compressor assembly according to claim 7 characterized by a paddle pump blade disposed in said blind hole.

* * * * *